United States Patent [19]

Pitts et al.

[11] Patent Number: 4,961,666

[45] Date of Patent: Oct. 9, 1990

[54] BINDING TABS

[75] Inventors: Warren R. Pitts, Needham; Barbara J. Burns, Auburn; Ralph J. Shuman, Needham, all of Mass.

[73] Assignee: Dennison manufacturing Company, Framingham, Mass.

[21] Appl. No.: 336,839

[22] Filed: Apr. 12, 1989

[51] Int. Cl.[5] ..... B42F 13/00

[52] U.S. Cl. ..... 402/79; 402/500; 283/81; 281/46

[58] Field of Search ..... 402/73, 75, 76, 77, 402/79, 500, 501; 281/2, 5, 38, 42, 46; 283/81

[56] References Cited

U.S. PATENT DOCUMENTS

| | | | |
|---|---|---|---|
| 1,023,715 | 4/1912 | Bristol | 402/79 |
| 1,843,771 | 2/1932 | Kline | 402/79 |
| 3,014,580 | 12/1961 | Brody et al. | 402/79 |
| 4,070,223 | 1/1978 | Stalzer | 281/2 X |
| 4,285,531 | 8/1981 | Balsamo | 281/2 X |
| 4,430,015 | 2/1984 | Nerlinger | 402/79 |
| 4,558,888 | 12/1985 | Hanson et al. | 281/5 |
| 4,660,855 | 4/1987 | Pagilaccio | 281/2 |
| 4,759,484 | 7/1988 | Richter | 281/2 |

FOREIGN PATENT DOCUMENTS

| | | | |
|---|---|---|---|
| 2028203 | 12/1971 | Fed. Rep. of Germany | 402/79 |
| 456018 | 6/1913 | France | 402/79 |
| 2521911 | 8/1983 | France | 402/79 |
| 60244 | 1/1939 | Norway | 402/79 |
| 124121 | 3/1919 | United Kingdom | 402/79 |
| 248591 | 3/1926 | United Kingdom | 402/79 |
| 940670 | 10/1963 | United Kingdom | 402/79 |

*Primary Examiner*—Paul A. Bell
*Assistant Examiner*—Yu-Chi Lin
*Attorney, Agent, or Firm*—Arthur B. Moore

[57] ABSTRACT

A tab for adhesively securing and binding articles within looseleaf binders and like devices, where such articles cannot be conveniently provided with apparatus for engagement by the binder rings. The tab includes a central, apertured portion advantageously comprising bilaterally symmetric apertured sections separated by a central fold line, and wing portions, all adhesive-coated. The tab is prepared for use by folding the respective halves of the central tab portion against each other with apertures aligned. The tab may then be inserted in a binder ring, and the wings of the tab adhesively secured to the article to be bound. Advantageously a plurallity of such tabs are included in a tab stock, such tab stock including an adhesive coated tab substrate (preferably transparent) and backing sheet.

9 Claims, 2 Drawing Sheets

BINDING TABS

The present invention relates to the binding of articles into looseleaf notebooks and the like, and more particularly to a binding tab for such purposes.

In order to retain sheets of paper, pads, and other articles in looseleaf binders it is customary to punch the paper or other article at locations corresponding to the rings of the binder. The requirement to provide retaining holes for the binder rings cannot conveniently be satisfied for certain articles, such as books, which might otherwise be conveniently retained in such binders.

Accordingly, it is a primary object of the invention to provide method and apparatus for convenient binding of articles in looseleaf binders.

SUMMARY OF THE INVENTION

In accordance with the above and additional objects, the invention provides a tab for holding articles in looseleaf binders, and a tab stock from which such tab may be conveniently formed. A tab constructed in accordance with the invention includes first and second wing portions for adhesively binding an article, and an apertured portion which may be retained by a ring of a looseleaf binder. By utilizing a plurality of such tabs (typically three) one may adhesively secure an article to be bound at multiple locations, to retain the article in respective rings of the looseleaf binder.

A tab stock for providing one or preferably more tabs as described above comprises a laminate in sheet form. Such tab stock includes a release substrate advantageously comprising a backing paper sheet coated with a silicone release layer or like release material; and a tab layer which is coated with a pressure sensitive adhesive and removably adhered to the silicone release layer. Preferably, the tab stock includes a plurality of such tabs, which may be adjacent and separated by perforation or score lines. It is desirable that the tab material and adhesive be transparent to permit viewing the article through the tab after binding. Each tab within the tab stock is subdivided into a central portion with dual, symmetric apertures, and wing portions on respective sides of the central portion. The central portion of the backing sheet and release layer is preferably separable from the wing portion of these layers along perforation or score lines so that the backing substrate is selectively removable (e.g. only the central portion might be removed, or either wing portion might be removed separately).

Such tab stock is employed to produce individual tabs and use these to retain an article in a looseleaf binder by removing one of the tab laminates from the remainder of the tab stock. The central portion only of the backing sheet is then removed, and the tab is folded in half along a center line of the central portion so that respective halves of the central portion are folded against and adhesively secured to each other with the apertures aligned. The tab is then inserted in a ring of a looseleaf binder, and backing sheets of the wing portions removed in order to adhesively secure the article to be bound.

BRIEF DESCRIPTION OF THE DRAWINGS

The above and additional aspects of the invention are illustrated in the detailed description of the preferred embodiment which follows, which should be consulted in conjunction with the drawings in which.

DETAILED DESCRIPTION

Figure 1:
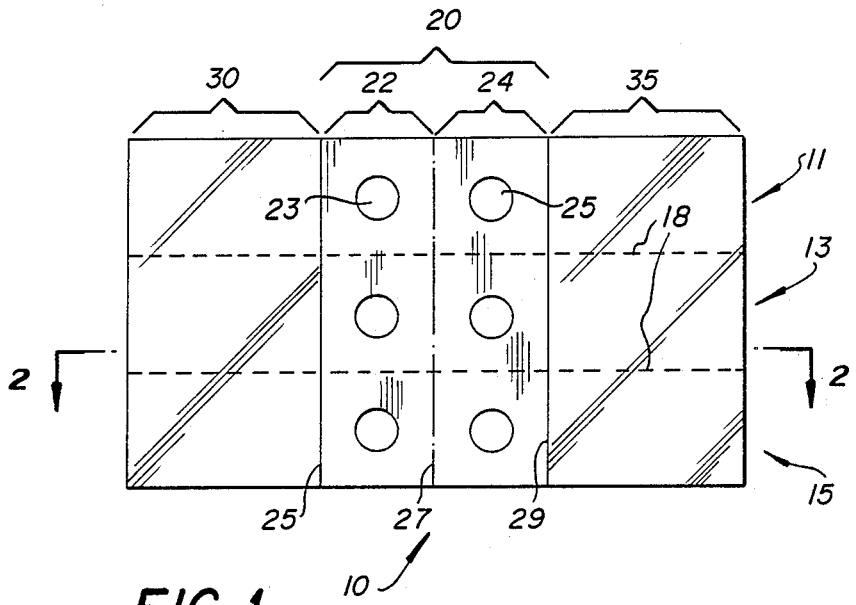
FIG. 1 is a plan view of a tab stock in accordance with the preferred embodiment of the invention, seen from the backing sheet side.
Figure 2:
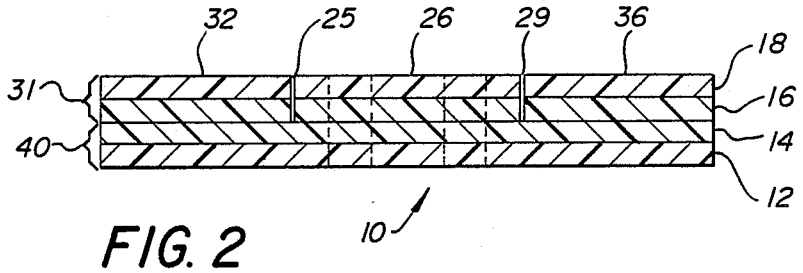
FIG. 2 is a sectional schematic view of the tab stock of FIG. 1, in a section taken along the lines 2—2.

Reference should now be had to FIGS. 1-5 for a detailed description of a preferred design of binder tab and tab stock for producing such tabs, according to the invention. FIG. 1 shows in a plan view a tab stock 10 including three proximately placed tab laminates 11, 13, and 15. The tab stock is perforated along horizontal perforation lines 18 which separate tabs 11, 13, and 15. A given tab 11 includes a central portion 20 and extreme portions or "wings" 30, 35. The central portion 20 is subdivided into symmetrical sections 22, 24 each including a centrally placed aperture 23, 25 respectively. As seen in FIGS. 1 and 2, the wings 30, 35 are separated from central portion 20 by score lines 25, 29 which penetrate only certain layers of the tab stock laminate. The center line 27 is a fold line at which the tab stock is not scored or perforated. This fold line may be inprinted on the substrate to assist the user in the folding process explained below.

FIG. 2 shows a sectional view of the tab stock laminate 10 taken along the section lines 2—2 in FIG. 1. The various layers of laminate 10 include the tab material 12; pressure sensitive adhesive layer 14; and release substrate layers 31 including paper backing sheet 18 and silicone release coating 16. Tab laminate 10 is scored or perforated through the backing substrate 31 (i.e. layers 16, 18) along score lines 25, 29, thereby to subdivide the backing sheet 31 into central portion 26 and wing portions 32, 36. Because of the release properties of the pressure sensitive adhesive 14 against the silicone release layer 16, any or all of the backing portions 26, 32, and 36 may be removed to expose respective portions of the tab layers 40.

It is preferred to employ a transparent tab material 12 and clear adhesive 14 to permit a bound article to be viewed through the tab. In a operative embodiment of the invention, the tab layer 12 consisted of 2 mil Mylar® film (Mylar is a registered trademark of E.I. DuPont De Nemours Co., Wilmington, Del. for a polyester film). Adhesive layer 14 comprised Flexcon V-22 ultra clear, permanent thermoset copolymer pressure sensitive adhesive; release layer 16 comprised Flexcon # 50 K-8 release liner (3.0 mils); and backing sheet 18 comprised 1.0 mil Mylar® Flexcon grade 100 C MT/C clear face stock with a bleached matt top coat; all supplied by Flexcon Corporation, Spencer, Mass.

Figure 3:
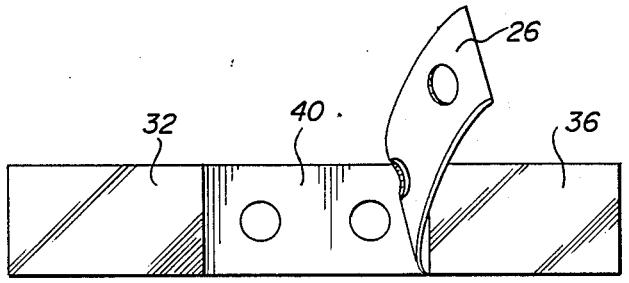
FIG. 3 is a plan view of an individual tab, showing the removal of the backing sheet of the central tab portion.
Figure 4:
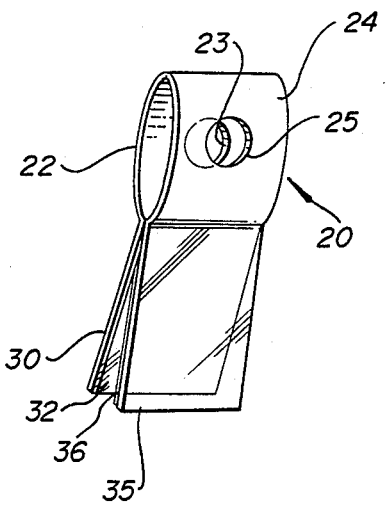
FIG. 4 is a perspective view of the tab of FIG. 3, in preparation for folding the central tab portion against itself.
Figure 5:
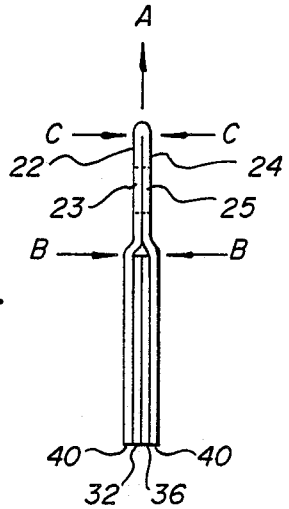
FIG. 5 is a side view of the tab of FIG. 4, after completion of the process of folding the central tab portion against itself.

Reference may now be had to FIGS. 3-6 to illustrate the process of producing individual tabs 40 from a tab stock and using these tabs to adhesively secure an article into a looseleaf binder. Initially, a given tab (for example, tab 11 in FIG. 1) is separated from the tab stock 10 along perforation line 18. Then, as seen in FIG. 3, the central portion 26 of the backing sheet is removed to expose the adhesive coated central portion of the tab. The tab is then folded in half as shown in FIG. 4 by aligning the wing portion 30, 35 of the tab. This will cause the central portion 20 of the tab to pillow, and the user then squeezes the respective halves 22, 24 of the central tab portion against each other by finger pressure. As shown in the side view of FIG. 5, the user commences this squeezing at the wings at points B and proceeds in direction A, completing the process at point C. This results in the two layers of the central tab portion being adhesively secured to each other with the apertures 23, 25 aligned.

Figure 6:
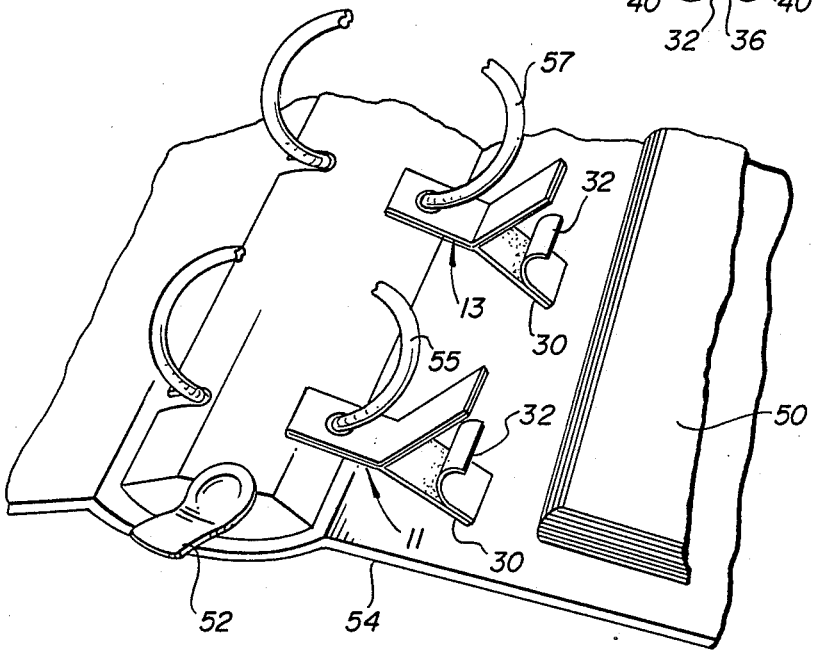
FIG. 6 is a partial perspective view of a looseleaf binder showing two tabs according to the invention retained by respective binder rings in preparation for binding a book.

Referring to FIG. 6, one or more tabs thus formed may be inserted in respective binder rings—two tabs are shown at 11, 13 respectively engaged by rings 55, 57. The user then removes the backing sheets of the tab wing portions in order to adhesively engage an article (book 50) to be bound. FIG. 6 illustrates the removal of backing sheets 32 of the lowermost wings 30 of tabs 11, 13, in preparation for pressing the book 50 against the adhesive coated wings 30. This would be followed by removing the backing sheets 32, 36 of the upper wing portions 35 to adhere these to book 50.

While various aspects of the invention have been set forth in the drawings and the specification, it is to be understood that the foregoing detailed description is for illustration only and that various changes in parts, as well as substitution of equivalent constituents for those shown and described, may be made without departing from the spirit and scope of the invention as set forth in the appended claims.

We claim:

1. A tab for binding articles in looseleaf binders, comprising an elongate foldable flat strip which is bilaterally symmetric around a central fold line, said tab having two apertured portions having respective discrete apertures on opposite sides of the central fold line, and first and second wing portions at the opposite ends of said elongate tab, wherein one face of the strip is coated with pressure sensitive adhesive and can be folded along the fold line and its apertured portions adhesively secured to each other with their apertures aligned, whereupon the wing portions can be adhesively secured to the article; said adhesive coated strip being releasably adhered to a carrier sheet which is divided into separately removable portions respectively adhered to the apertured portions and wing portions of the tab.

2. A tab as defined in claim 1, wherein the first and second wing members and the adhesive are transparent.

3. A tab as defined in claim 1, wherein the strip is rectangular.

4. A tab stock laminate comprising a tab layer, a pressure sensitive adhesive layer backing the tab layer, and a release sheet removably adhered to the adhesive layer; said laminate being separable into a plurality of tabs, each tab comprising a bilaterally symmetric elongate strip with a central fold line, first and second apertured portions having respective discrete apertures on opposite sides of the central fold line, and first and second wing portions at opposite ends of the strip; said release sheet being divided into separately removable portions respectively backing the apertured portions and wing portions of the tabs.

5. A tab stock laminate as defined in claim 4 wherein the individual tabs are separable along perforation lines.

6. A tab stock laminate as defined in claim 4 wherein the individual tabs are separable along score lines.

7. A tab stock laminate as defined in claim 4, wherein the tab layer and adhesive layer are transparent.

8. A tab stock laminate as defined in claim 7 wherein the tab layer is comprised of transparent foldable plastic and the adhesive layer comprises pressure sensitive adhesive.

9. A tab as defined in claim 4, wherein the median fold line is printed on the tab layer.

* * * * *